US006533617B1

(12) United States Patent
D'Addario

(10) Patent No.: US 6,533,617 B1
(45) Date of Patent: Mar. 18, 2003

(54) ELECTRICAL PLUG CONNECTORS

(75) Inventor: James D'Addario, Old Westbury, NY (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 09/478,872

(22) Filed: Jan. 7, 2000

(51) Int. Cl.[7] ..... H01R 17/18
(52) U.S. Cl. ..... 439/669
(58) Field of Search ..... 439/669, 668, 439/825, 499, 188

(56) References Cited

U.S. PATENT DOCUMENTS

| | | | |
|---|---|---|---|
| 1,668,583 A | | 5/1928 | Carter |
| 2,368,914 A | | 2/1945 | Bowen |
| 2,610,223 A | | 9/1952 | Puerner |
| 3,418,438 A | | 12/1968 | Barrett |
| 3,536,870 A | | 10/1970 | Izumi |
| 3,602,632 A | | 8/1971 | Ollis |
| 3,648,224 A | | 3/1972 | McDonough |
| 3,660,805 A | | 5/1972 | McDonough |
| 3,728,787 A | | 4/1973 | McDonough |
| 3,815,054 A | | 6/1974 | McClure et al. |
| 3,845,453 A | | 10/1974 | Hemmer |
| 3,889,049 A | | 6/1975 | Legg et al. |
| 3,889,063 A | | 6/1975 | Slavin |
| 3,893,743 A | | 7/1975 | Wallo |
| 3,949,180 A | | 4/1976 | Ojima et al. |
| 3,966,292 A | | 6/1976 | Schultz |
| 4,012,577 A | | 3/1977 | Lang et al. |
| 4,018,501 A | * | 4/1977 | Maloof ..... 439/669 |
| 4,024,345 A | | 5/1977 | Kochem |
| 4,076,966 A | | 2/1978 | Bovo et al. |
| 4,131,757 A | | 12/1978 | Felkel |
| 4,158,185 A | | 6/1979 | Dageforde et al. |
| 4,191,443 A | | 3/1980 | Doyle |

(List continued on next page.)

FOREIGN PATENT DOCUMENTS

| | | |
|---|---|---|
| DE | 42 40 556 | 6/1993 |
| EP | 0 923 170 | 6/1999 |

*Primary Examiner*—Brian Sircus
*Assistant Examiner*—Phuong Dinh
(74) *Attorney, Agent, or Firm*—Alix, Yale & Ristas, LLP

(57) ABSTRACT

A plug connector is provided for mating with a jack connector. The plug connector includes a base and a tubular member extending from the base. The tubular member includes a contact area, a conductive end distal to the base and a spring. The conductive end is insulated from the contact area and may have a circumferential groove located thereon. A core may be disposed within the tubular member and has an insulative material disposed about at least one signal conductor. An RCA type plug connector is also provided. The RCA plug connector includes an insulating ring having a central aperture and a probe member extending from the central aperture. The probe member has a spring portion and a terminal end and a conductive sleeve may be disposed about the insulating ring.

34 Claims, 11 Drawing Sheets

U.S. PATENT DOCUMENTS 4,249,790 A 2/1981 Ito et al.
4,250,351 A 2/1981 Bridges
4,364,625 A 12/1982 Baker et al.
4,392,699 A 7/1983 Weingartner
4,392,708 A 7/1983 Bailey et al.
4,393,283 A 7/1983 Masuda
4,426,558 A 1/1984 Tanaka et al.
4,447,108 A 5/1984 Ghigliotti et al.
4,461,923 A 7/1984 Bogese, II
4,526,429 A 2/1985 Kirkman
4,510,346 A 4/1985 Bursh, Jr. et al.
4,538,023 A 8/1985 Brisson
4,548,447 A 10/1985 Dinsmore
4,561,716 A 12/1985 Acke
4,565,629 A 1/1986 Wilson et al.
4,588,854 A 5/1986 Bailey et al.
4,628,159 A 12/1986 Deitch et al.
4,647,127 A 3/1987 Weingartner
4,657,327 A 4/1987 Weingartner
4,659,167 A 4/1987 Masuda
4,684,981 A 8/1987 Toyoshima et al.
4,692,731 A 9/1987 Osinga
4,708,415 A 11/1987 White
4,734,064 A 3/1988 Knapp et al.
4,746,303 A 5/1988 Cobraiville et al.
4,750,897 A 6/1988 Neidecker
4,752,235 A 6/1988 Roux et al.
4,767,890 A 8/1988 Magnan
4,777,324 A 10/1988 Lee
4,780,097 A 10/1988 Piscitelli
4,789,360 A 12/1988 Paul et al.
4,808,128 A 2/1989 Werth
4,814,548 A 3/1989 Traversino et al.
4,815,132 A 3/1989 Minami
4,825,021 A 4/1989 Pauza
4,837,927 A 6/1989 Savage, Jr.
4,850,898 A 7/1989 Gallusser
4,878,849 A 11/1989 Talwar et al.
4,889,497 A 12/1989 Riches
4,907,981 A 3/1990 Gallusser et al.
4,920,233 A 4/1990 Kincaid
4,922,536 A 5/1990 Hoque
4,932,873 A 6/1990 LaShier
4,932,900 A 6/1990 Gliha
4,939,315 A 7/1990 Palmer
4,945,189 A 7/1990 Palmer
4,954,096 A 9/1990 Frank
4,994,686 A 2/1991 Brisson
5,015,195 A 5/1991 Piriz
5,022,872 A 6/1991 Shichida
5,064,966 A 11/1991 Palmer
5,075,518 A 12/1991 Matsumoto
5,109,140 A 4/1992 Nguyen
5,137,469 A 8/1992 Carpenter et al.
5,137,477 A 8/1992 Wright
5,147,221 A 9/1992 Cull et al.
5,167,543 A 12/1992 Wurster
5,180,317 A 1/1993 Franks, Jr.
5,205,749 A 4/1993 Weingartner
5,211,582 A 5/1993 Morse et al.
5,217,395 A 6/1993 Bailey et al.
5,219,304 A 6/1993 Lin
5,232,378 A 8/1993 Weingartner
5,238,422 A * 8/1993 Scheer ..... 438/188
5,246,389 A 9/1993 Briones
5,261,839 A 11/1993 Franks, Jr.
5,263,879 A * 11/1993 Sasa et al. ..... 439/668
5,267,871 A 12/1993 Flanagan
5,269,711 A 12/1993 Wright
5,281,174 A 1/1994 Bonner
5,290,179 A 3/1994 Weingartner
5,290,181 A 3/1994 Bixler et al.
5,305,547 A 4/1994 Weiss
5,326,278 A 7/1994 Logerot et al.
5,338,215 A 8/1994 Lee et al.
5,393,249 A 2/1995 Morgenstern et al.
5,397,253 A 3/1995 Fries
5,401,192 A 3/1995 Briones et al.
5,403,207 A 4/1995 Briones
5,403,214 A 4/1995 Tirrell
5,407,366 A 4/1995 Briones et al.
5,419,707 A 5/1995 Kelley
5,471,740 A 12/1995 Morse et al.
5,508,621 A 4/1996 Wong
5,527,190 A 6/1996 Weingartner
5,548,082 A 8/1996 Palmer
5,575,694 A 11/1996 Hawkins et al.
5,586,910 A 12/1996 Negro et al.
5,634,830 A 6/1997 Weingartner
5,685,739 A 11/1997 Davis et al.
5,695,357 A 12/1997 Wright
5,710,851 A 1/1998 Walter et al.
5,725,386 A 3/1998 Davis et al.
5,741,152 A 4/1998 Boutros
5,775,946 A 7/1998 Briones
5,797,774 A 8/1998 Kaneko
5,809,136 A 9/1998 Turner
5,823,829 A 10/1998 Suzuki
5,860,824 A 1/1999 Fan
5,895,294 A 4/1999 DeLangis et al.
5,897,397 A 4/1999 Yokozawa
5,915,995 A 6/1999 Meyer et al.
5,927,999 A 7/1999 Shimojyo
5,951,337 A 9/1999 Brake
6,093,054 A * 7/2000 Merkle et al. ..... 439/493
6,193,559 B1 2/2001 Weingartner

* cited by examiner

ELECTRICAL PLUG CONNECTORS

CROSS REFERENCE TO RELATED APPLICATION

The present application is related to copending U.S. patent application Ser. No. 09/478,866, entitled "Electrical Plug and Jack Connectors", filed on an even date herewith and assigned to J. D'Addario & Company, Incorporated.

BACKGROUND OF THE INVENTION

1. Field of the Invention

The present invention relates generally to electrical plug and jack connectors and, more particularly, relates to electrical plug and jack connectors configured to provide reduced movement therebetween when connected together and reduced likelihood of electrical discontinuity therebetween.

2. Description of Related Art

Plug and jack type connectors are well known for use in connecting, e.g., audio equipment. Typically, the plugs and jacks may connect a signal line and a ground (e.g., referred to as a mono type of connection) or two signal lines and a ground (e.g., referred to as a stereo type of connection). Generally, the jack includes a single wiper contact for each conductive portion of the plug. Because of, e.g., resiliency in the wipers and clearance, the plugs are somewhat moveable within the jack and through wear and the like the movement increases.

One typical use for a plug and jack connector is in the connection between a musical instrument and an amplifier. For example, electric guitars typically employ a jack which receives a plug connected to one end of a cord. The other end of the cord may go directly to an amplifier or may connect to a radio transmitter linked to the amplifier. During playing of the guitar and movement thereof, a torque may be created on the plug connector by movement of the instrument causing movement of the plug within the jack resulting in intermittent electrical contact between the jack and plug. In turn, sound from the instrument may be intermittently output from the amplifier and/or "clicking" sounds may be generated by this intermittent contact.

SUMMARY OF THE INVENTION

Accordingly, it is an object of the present invention to provide a plug connector which achieves reduced relative movement when mated with a jack connector.

It is another object to provide a jack connector which reduces the possibility of electrical discontinuity between the jack and a plug disposed therein while also assisting in reducing the relative movement therebetween.

It is a further object to provide low cost and high quality electrical jack and plug connectors.

In accordance with an embodiment of the present invention, a plug connector is provided for mating with a jack connector. The plug connector comprises a base and a tubular member extending from the base. The tubular member includes a contact area, a conductive end distal to the base, a circumferential groove located thereon and a spring. The conductive end is insulated from the contact area.

In particular aspects of the present invention, the tubular member may further comprise an intermediate conductive portion disposed between and insulated from the contact area and the conductive end. A core which includes an insulative material disposed about at least one signal conductor may be disposed within the tubular member. The spring may include at least one strip bowed radially outward of and extending along the central axis of the tubular member.

In accordance with another embodiment of the present invention an RCA plug connector is provided. The RCA plug connector comprises an insulating ring having a central aperture and a probe member extending from the central aperture. The probe member has a spring portion and a terminal end and a conductive sleeve may be disposed about the insulating ring.

The present invention provides jack and plug connectors which have reduced relative movement therebetween and thereby prevents, for example, generation by an audio connection intermittent and undesirable sounds.

BRIEF DESCRIPTION OF THE DRAWINGS

Other objects and advantages of the invention will be evident to one of ordinary skill in the art from the following detailed description made with reference to the accompanying drawings, in which.

DETAILED DESCRIPTION OF THE PREFERRED EMBODIMENT

Figure 1:
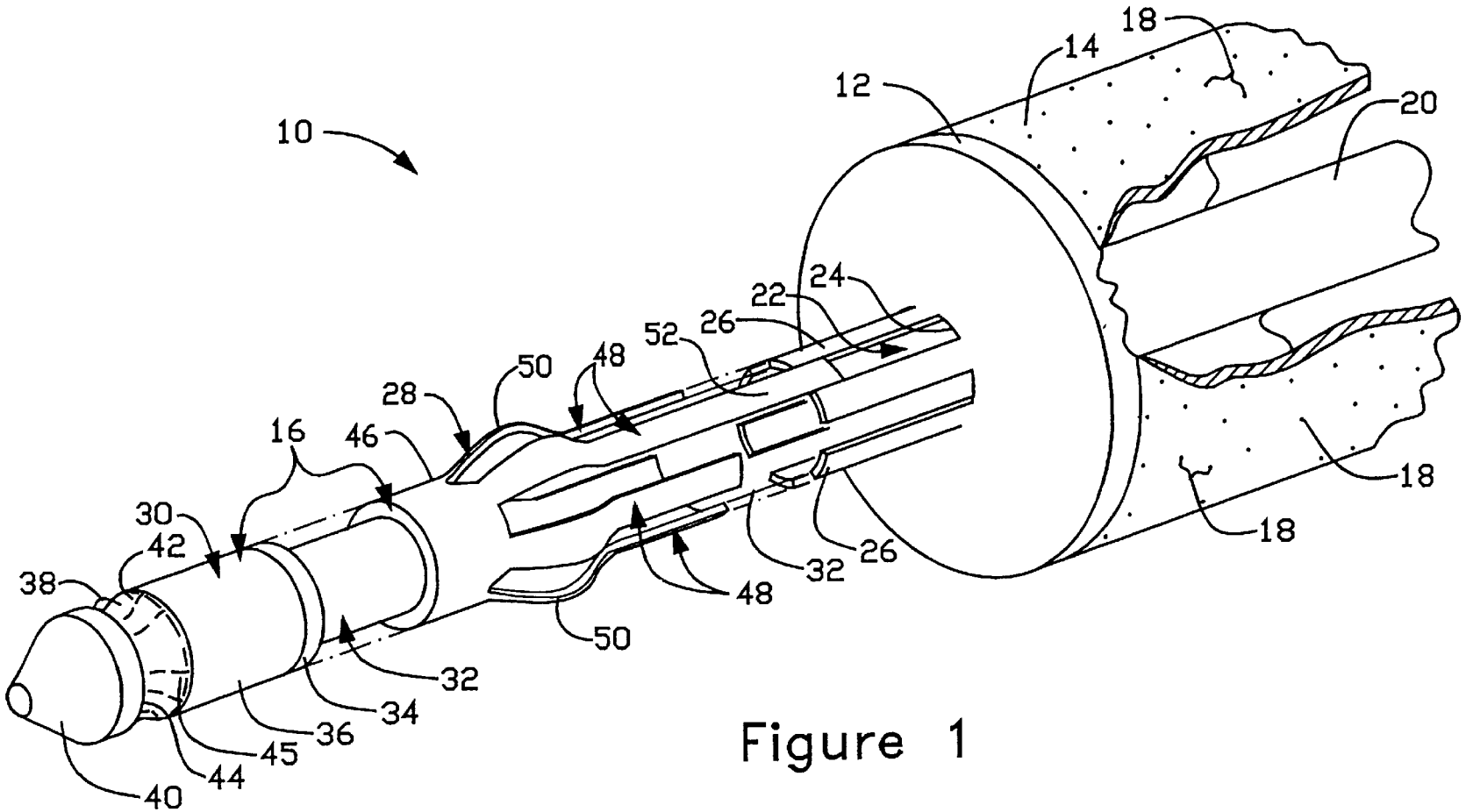
FIG. 1 is a partially exploded perspective view, partially broken away, illustrating a plug connector in accordance with an embodiment of the present invention.

A plug connector in accordance with one embodiment of the present invention is illustrated generally at 10. The plug connector 10 comprises a base 12 interposed between a handle portion 14 and a tubular member 16.

The handle portion 14 may be composed of any suitably rigid material which may include friction enhancing bumps 18 for an enhanced frictional grip.

A wire 20 is connected to the base 12 and may include a shielded single line (not shown) for conducting a signal as is well known.

The base 12 may be composed of an insulating material such as a molded thermoplastic, e.g., an acetal resin, a nylon, an ABS resin and/or blends thereof and comprises a disk like shape and a central aperture 22 defined by a wall 24. Members 26 extend from the wall 24 and are circumferentially spaced thereabout and generally define a tubular shape.

The tubular member 16 comprises a spring portion 28 and a terminal end 30, both of which are disposed about a core member 32. The core member 32 comprises an insulating material such as a thermoplastic material as discussed above disposed about a conductor (not shown) and functions to electrically connect the terminal end 30 with the signal carrying portion of the wire 20 in a known manner.

The terminal end 30 may be composed of any suitably strong and durable material and is preferably a conductive material, e.g., a metallic substance such as copper, brass, steel plated with nickel, copper or gold for a low resistance, brass, beryllium copper, phosphor bronze or other material or alloy and is disposed adjacent an insulating ring 34 formed of, for example, a thermoplastic substance such as discussed above. The terminal end 30 comprises a cylindrical length 36, a groove 38 and a contact tip 40. The groove 38 is defined by a pair of shoulders 42 and 44 which may be separated by a curved portion 45.

In accordance with a feature of the present invention, the spring portion 28 functions to, e.g., reduce movement of the plug connector 10 when disposed within a jack connector as discussed in more detail below. The spring portion 28 comprises a cylindrical contact area 46 and circumferentially spaced strips 48 extending therefrom along a central axis of the tubular member 16. The cylindrical contact area 46 and strips 48 may be composed of the same material as the terminal end 30 providing it is a suitably flexible and sufficiently strong material and is preferably spring tempered. Suitable materials include, for example, copper, steel plated with, e.g., nickel, copper or even gold for a low resistance, brass, beryllium copper, phosphor bronze or other materials or alloys. The strips 48 are bulged at 50 in order to provide a spring-like resiliency and are sufficiently spaced to fit between the members 26 of the base 12. The strips 48 flex when mated with a jack as discussed in more detail hereafter. One of the strips 48 includes a contact extension 52 for electrical contact with, e.g., the conductive shielding of wire 20 in a known manner.

Figure 2:
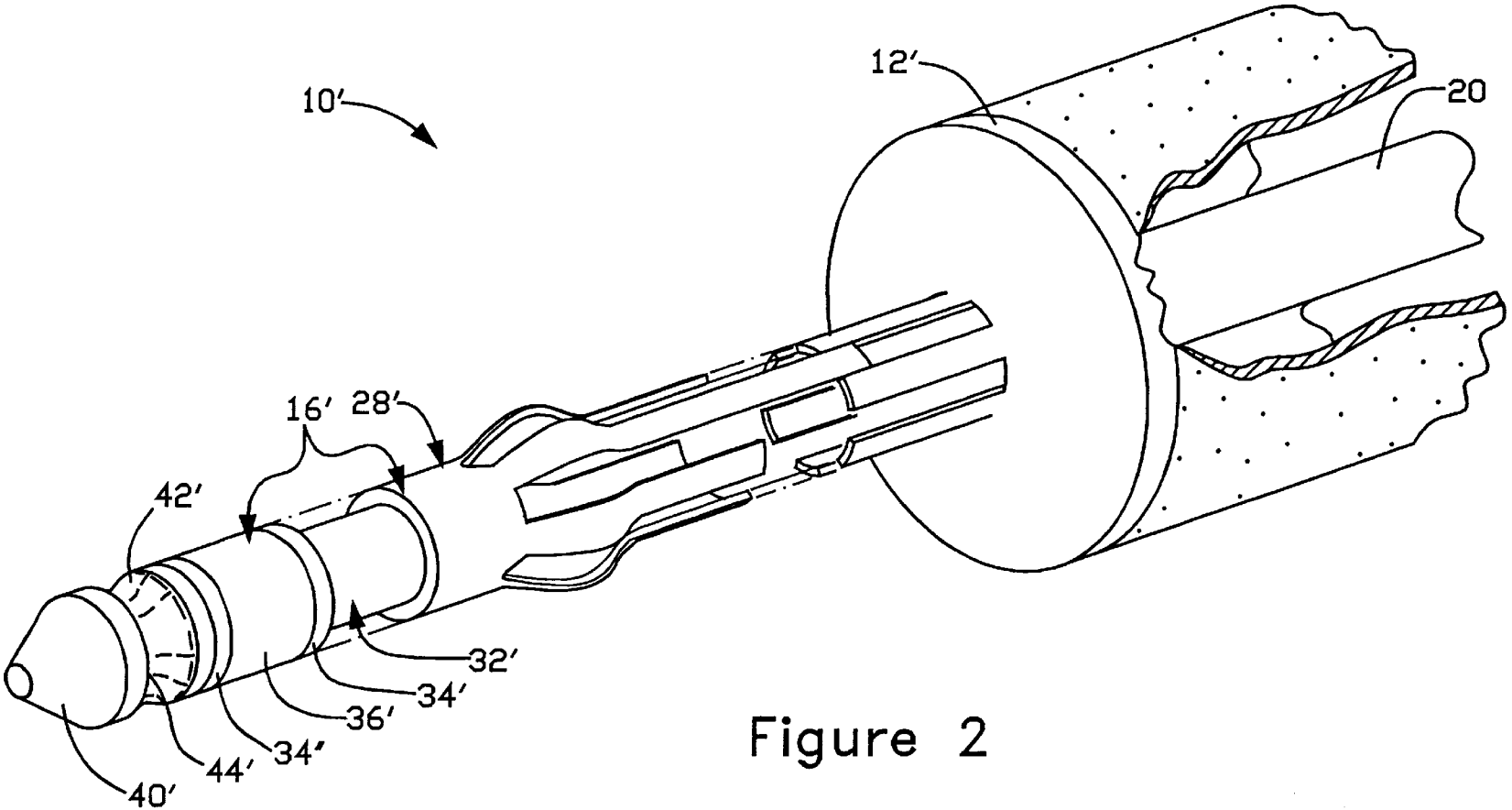
FIG. 2 is a partially exploded view of a plug connector in accordance with another embodiment of the present invention.

Referring now to FIG. 2, there is shown a plug connector 10' in accordance with another embodiment of the invention. In this embodiment, the plug connector 10' comprises three electrical contacts suitable for use in a stereo audio connection. In this case, the wire 10' carries two separately conductive lines (not shown) which are wrapped by a shield (not shown). The conductive lines may be electrically connected to a core member 32' which is an insulator disposed around two conductive lines extending within the insulator.

In order to provide an additional contact area, a pair of insulating rings 34' and 34" are provided and may be composed of the same material such as a thermoplastic material as the other insulating rings discussed above. The rings 34' and 34" insulate an additional cylindrical intermediate contact 36' which is separately conductive from spring portion 28' and shoulders 42', 44' and tip 40'. The cylindrical intermediate contact 36' is connected to one of the conductive lines of the core member 32' in a known manner.

Figure 4:
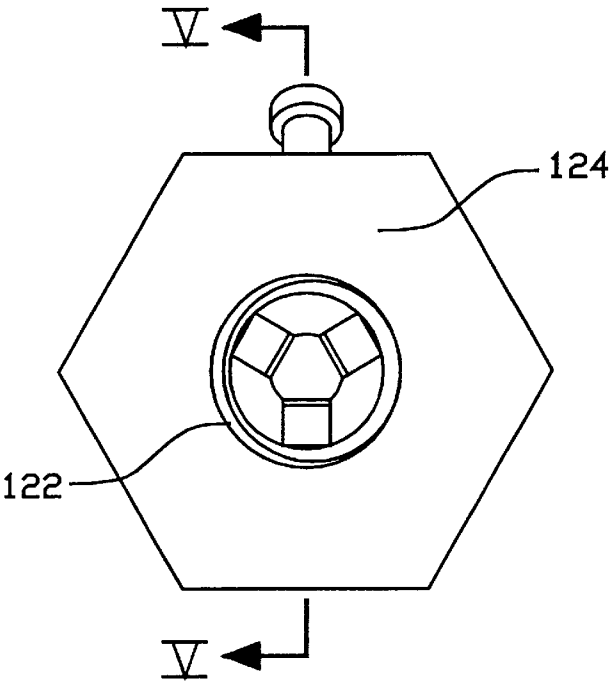
FIG. 4 is a side elevational view of the jack connector of FIG. 3.
Figure 3:
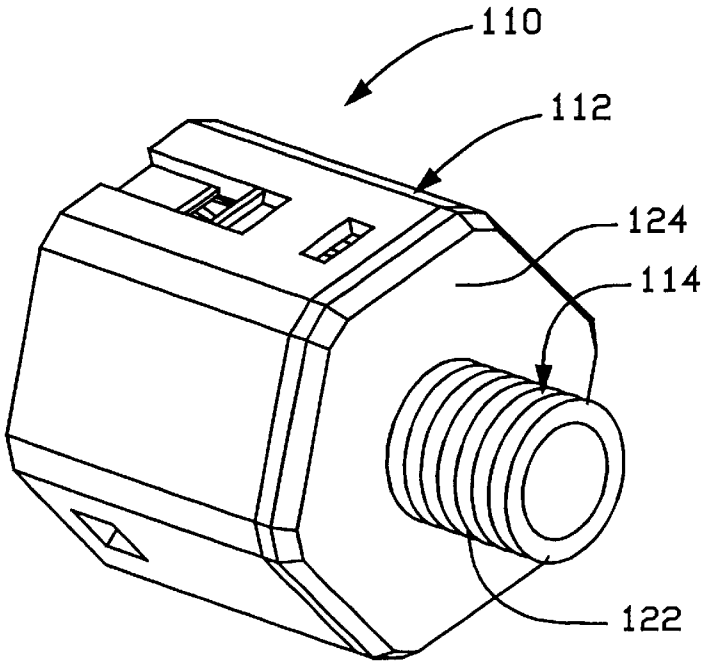
FIG. 3 is a perspective view of a jack connector, connectable with the plug connector of FIG. 1, in accordance with another embodiment of the present invention.
Figure 9:
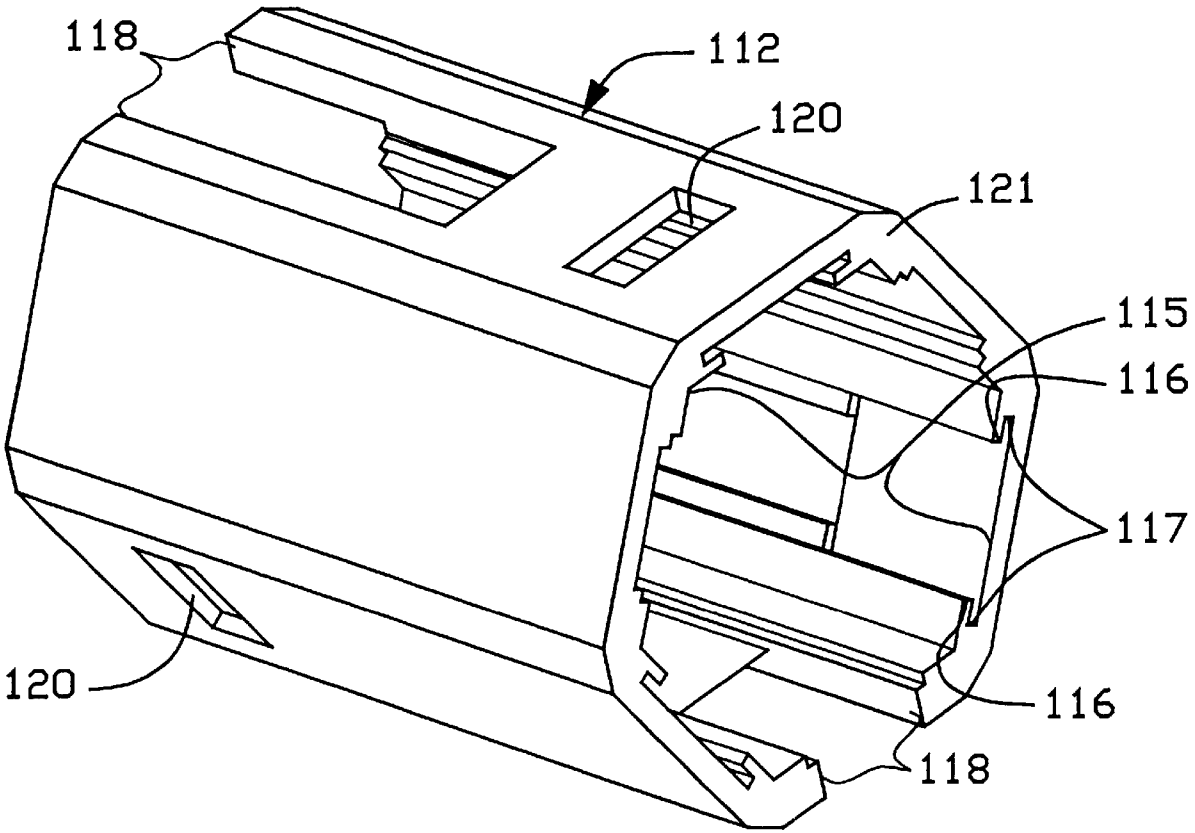
FIG. 9 is a perspective view of a portion of a jack housing in accordance with the embodiment of FIG. 3.

Referring now to FIGS. 3, 4 and 9, a jack connector is illustrated generally at 110. The jack connector 110 is preferably employed in combination with the plug connector 10 shown in FIG. 1 and discussed above, although, it will be understood that the jack connector may be employed with other compatible connectors and this is also the case for the plug connector.

The jack connector 110 comprises a body or housing 112 and a collar 114. The housing 112 may be composed of any suitably strong and durable insulating material such as a thermoplastic, for example, including any of those discussed above. The housing 112 comprises a generally tubular body including a central cavity 115, stepped portions 116 and channels or mounting slots 117 for receipt of electrical contacts as discussed in more detail below. The housing 112 also comprises through slots 118, window portions 120 and end 121.

The collar 114 may be composed of any suitably strong and durable metallic material, e.g., copper, steel plated with, e.g., nickel, copper or even gold for a low resistance, brass, beryllium copper, phosphor bronze or other material or alloy and is provided for engaging with, e.g., the strips 48 (FIG. 1) of the spring portion 28 of the plug connector 10. It will be appreciated that the collar 114 may also be composed of material such as a thermoplastic, e.g., any of those discussed above, although, wear may be enhanced where the corresponding plug employs a spring such as spring portion 28 (FIG. 1) discussed above. Preferably, the collar 114 is dimensioned to receive a spring such as spring portion 28 of the plug connector 10 to thereby provide a clamped fit between the plug connector and the jack connector 110 for reducing relative movement therebetween. The collar 114 comprises a threaded section 122 for mounting of the jack connector within, e.g., a musical instrument or amplifier (not shown) and a flange 124. The flange 124 is dimensioned to engage the end 121 of the housing 112 and, preferably, during manufacture the collar 114 may be insert molded with the housing. In such a case, extension tabs 125 of housing 112 may extend over the flange 124. The collar 114 may, in the case of a thermoplastic material, be fixed to the end 121 thereto by, for example, a suitable adhesive or ultrasonic welding. The diameter of the collar 122 is dimensioned to receive, for example, the spring portion 28 of the plug connector 10 (FIG. 1).

Figure 5:
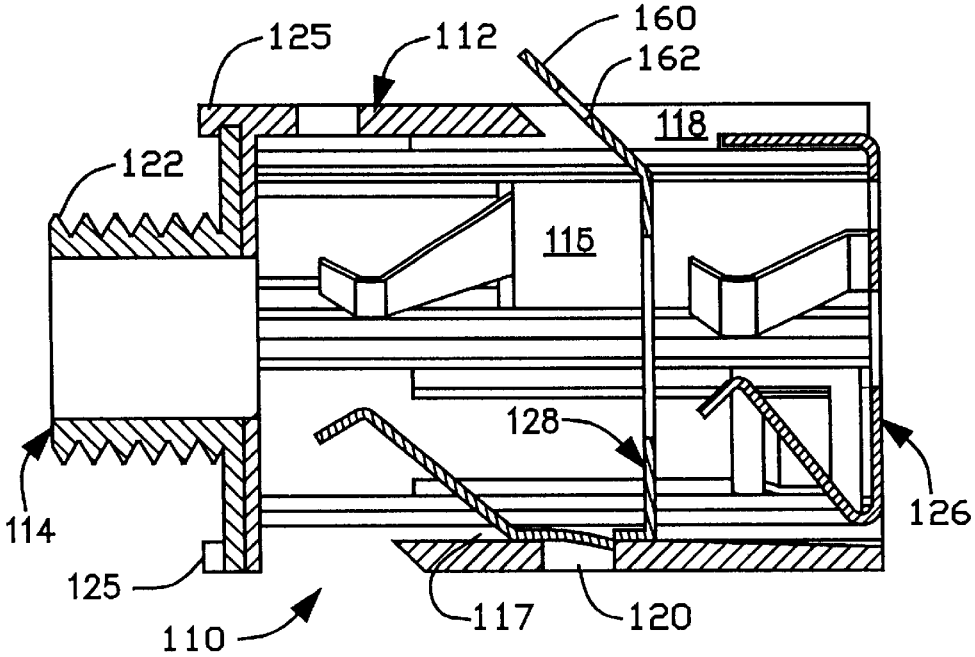
FIG. 5 is a sectional view taken along line V of FIG. 4.
Figure 7:
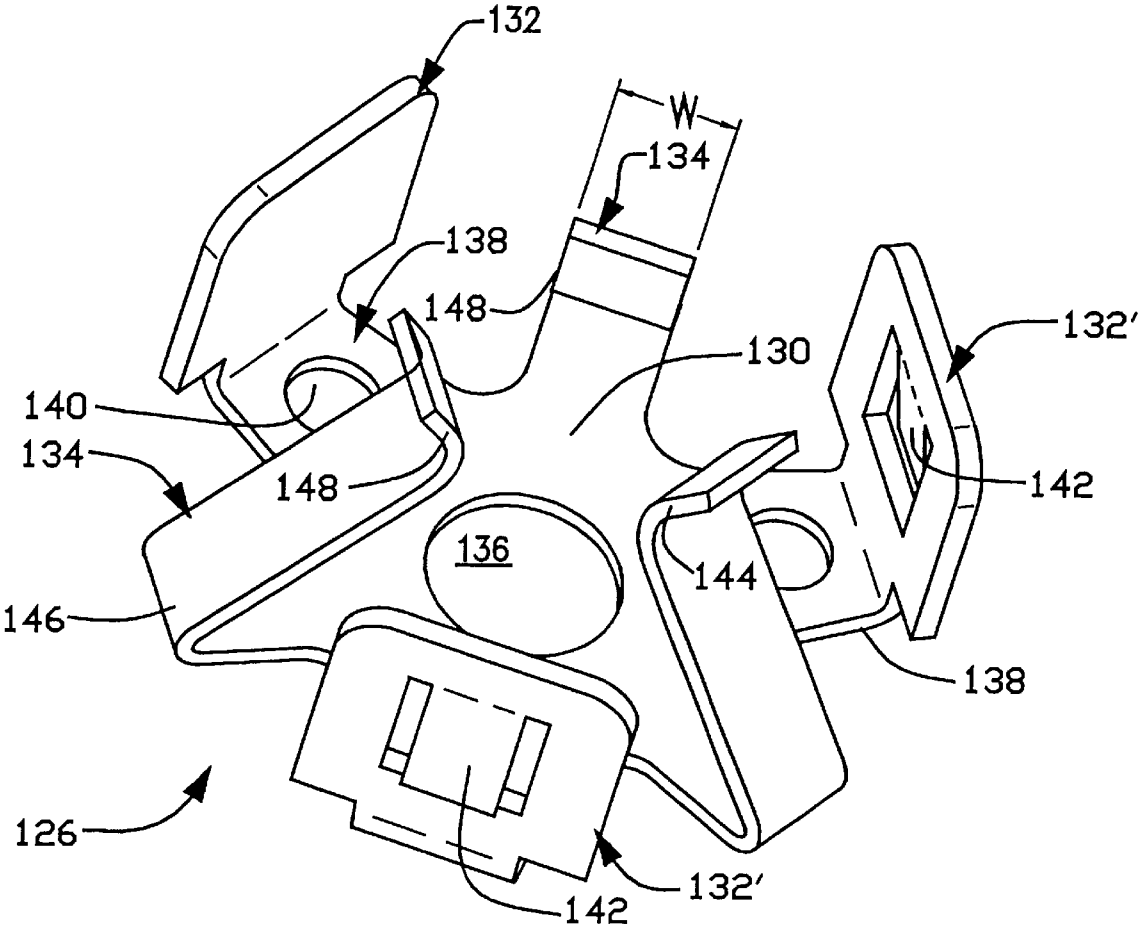
FIG. 7 is a perspective view of a contact element in accordance with the embodiment of FIG. 3.
Figure 8:
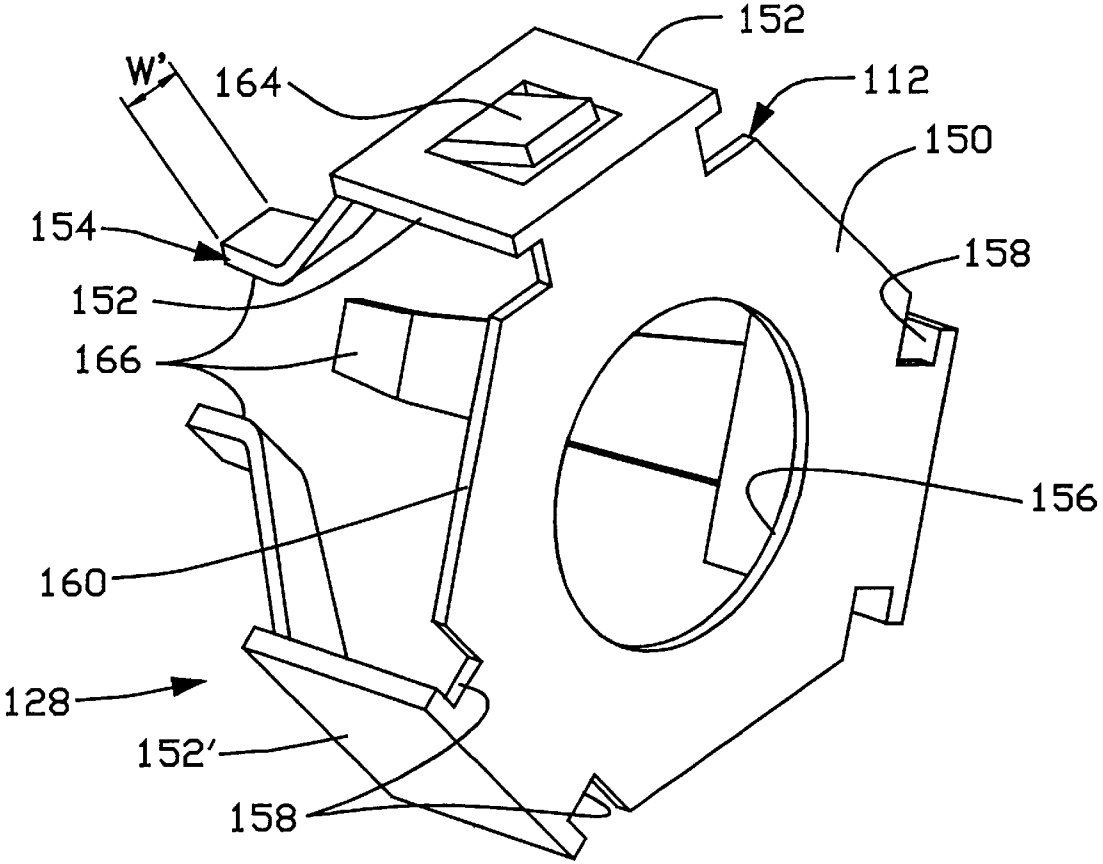
FIG. 8 is a perspective view of another contact element in accordance with the embodiment of FIG. 3.

With reference to FIGS. 5, 7 and 8, the jack connector 110 comprises an electrical contact element 126 and an electrical contact element 128. In accordance with another feature of the present invention, one or both of the electrical contact elements 126 and 128 comprise multiple contact wipers (discussed in more detail below) which increase the electrical contact surface area over a broad circumference of a plug connector thereby substantially reducing the possibility of electrical discontinuity between the jack connector and the plug connector when connected together.

In accordance with a feature of the present invention the electrical contact element 126 is configured as illustrated. The electrical contact element 126 may be composed of any suitably strong conductive material such as a metallic substance which is preferably spring tempered. Suitable materials include, for example, copper, steel plated with, e.g., nickel, copper or even gold for a low resistance, brass, beryllium copper, phosphor bronze or other material or alloy. The electrical contact element 126 comprises a hub 130 from which mounting plates 132 and contact wipers 134 extend. The hub 130 also includes a central aperture 136 and each mounting plate 132 is connected to the hub 130 by a connector arm 138. One or more of the connector arms 138 may include an aperture 140 whereto an electrical line (not shown) of, e.g., a musical instrument may be connected. It will also be understood that one or more of the mounting plates 132 may include an angled brace 142. When the electrical contact element 126 is mounted within the housing 112, the mounting plates fit within mounting slots 117 and the angled braces 142 slip into windows 120 to thereby lock the electrical contact element 126 in place.

The contact wipers 134 extend from the hub 130 and may have a generally constant width W and may be generally flat in cross section. The contact wipers 134 each include bent outer ends and a bent inner portion 146. The bent outer end 144 includes a curved portion 148 which is preferably dimensioned to fit within and generally match the curvature of the groove 38 of the plug connector 10 (FIG. 1). The contact wipers 134 may function to engage, e.g., shoulders 42 and 44 (FIG. 1) to thereby assist in reducing movement of the plug connector 10 within the jack connector 110.

In accordance with a further feature of the present invention an electrical contact element 128 is provided. The electrical contact element 128 may be composed of the same material as the electrical contact element 126 and comprises a hub 150, mounting plates 152 and wiper contacts 154. The hub 150 includes an aperture 156 where through a plug connector such as plug connector 10 (FIG. 1) may pass. Referring now also to FIG. 9, the hub 150 also comprises notches 158 which are shaped to receive the stepped portions 116 of the housing 112. The mounting plate 152 is dimensioned to fit within a mounting slot 117 of the housing 112.

A wire contact 160 extends from the hub 150 and includes an aperture 162 for receiving a signal wire from, e.g. a musical instrument (not shown) and the wire contact 160 is dimensioned to extend through the slot 118 of the housing 112. At least one of the mounting plates 152 comprises an angled brace 164 which, similar to angled brace 142, snaps into place adjacent the edge of the window 120 of the housing 112. Wiper contacts 154 are each connected to a mounting plate 152 and have a width W' which tapers from the fixed end (not numbered) to the free end thereof (not numbered). The wiper contacts 154 comprise bent portions 166 for contacting, e.g., the plug connector 10 (FIG. 1).

In accordance with a further feature of the present invention, the jack connector 110 may be manufactured by molding the housing 112, after inserting collar 114 in a suitable mold, to form the features thereof as described above. Also, a contacts 126, 128 with the structure discussed above may be formed, e.g., by stamping a thin sheet of a material as discussed above. Next, the electrical contact element 128 may be mounted within the central cavity 115 of the housing 112 whereby the wire contact 160 slides within slot 118 and the angled brace 164 snaps into window 120. The electrical contact element 126 may then be mounted to the central cavity 115 whereby the angled brace 142 snaps into another window 120.

Figure 6:
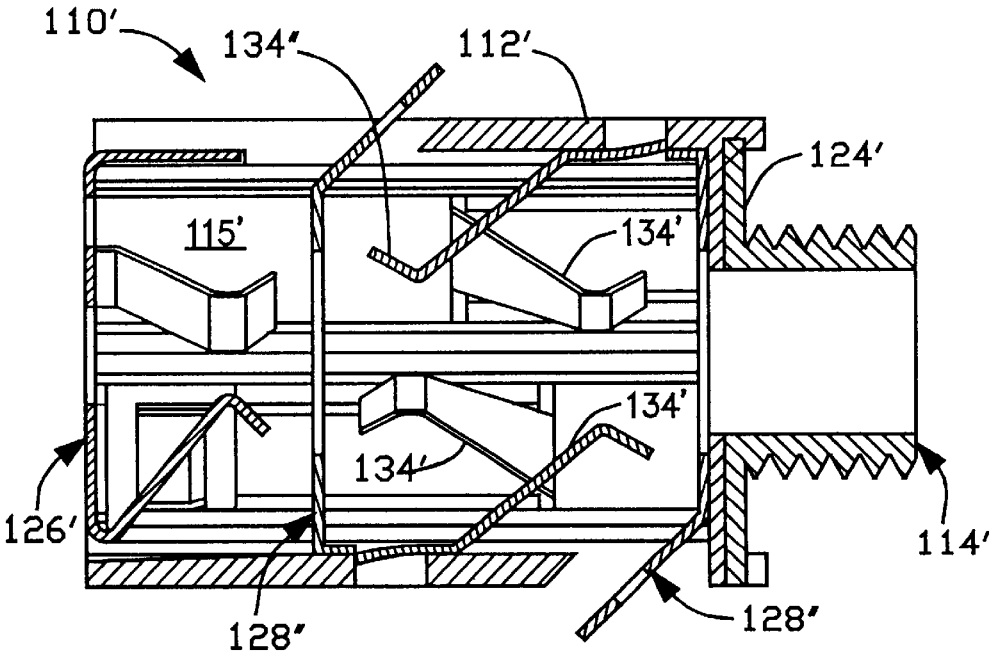
FIG. 6 is a sectional view similar to that of FIG. 4 illustrating a jack, connectable with the plug connector of FIG. 2, in accordance with another embodiment of the present invention.

Another embodiment of a jack connector in accordance with a further feature of the present invention is illustrated generally at 110' in FIG. 6. The jack connector 110' is preferably employed in combination with the plug connector 10' of FIG. 2, although, it will be understood that the jack connector may be employed with other compatible connectors and the same is true of the plug connector. In this embodiment, a third electrical contact element is provided for receiving a plug carrying, for example, two separate signals and a ground or shield. In accordance with this embodiment, an electrical contact 126', electrical contact element 128' and an additional electrical contact element 128" are mounted within the central cavity 115' of a housing 112'. It will be understood that a portion of housing 112' may be disposed between a flange 124' of the collar 114' and the contact element 128" in order to provide insulation therebetween.

The electrical contact element 128" is preferably the same as the electrical contact element 128 (FIG. 8) discussed above, although, when mounted to the housing 112' the electrical contact element 128" may be oriented within the central cavity 115' such that the contact wipers 134" extend in a direction which is opposite to that of contact wipers 134' of electrical contact element 128'. It will be appreciated that this arrangement allows for the formation of interchangeable parts between the embodiments of FIGS. 5 and 6 when desired.

Manufacture and assembly of the embodiment of FIG. 6 is similar to that of the embodiment of FIG. 5, although, an additional step of forming and assembling the electrical contact element 128' is required. Also, it may be advantageous to insert the electrical contact element 128" along with the collar 114' during molding of the housing 112'.

Figure 10:
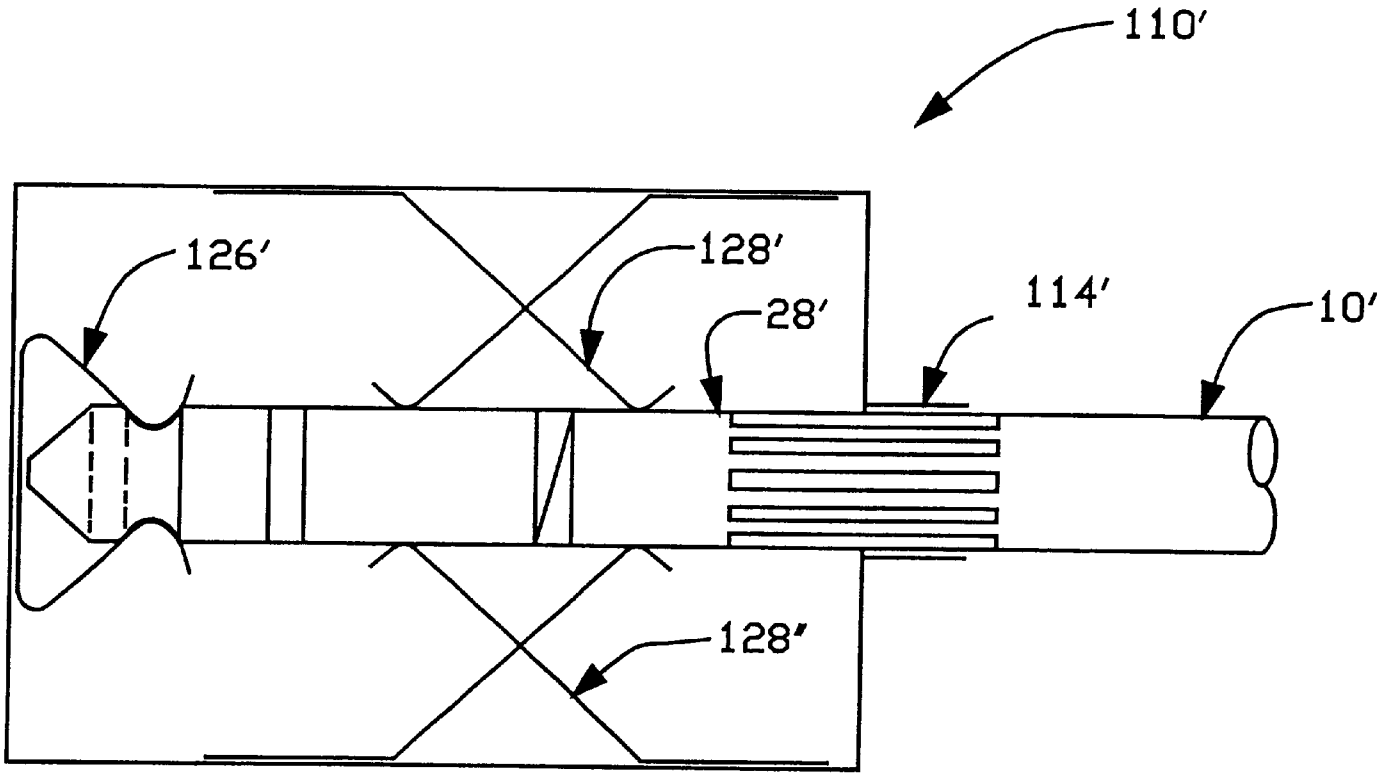
FIG. 10 is a schematical view of a portion of the plug connector of FIG. 2 disposed within the jack connector of FIG. 6.

As schematically illustrated in FIG. 10, the plug connector 10' may be inserted within the jack connector 110' and is supported in place there within by engaging the electrical contact elements 126', 128' and 128" . The spring portion 28' of the plug connector 10' engages the collar 114' to further clamp the plug connector within the jack connector 110' and thereby reduce the amount of movement of the former relative to the latter. It will be understood that the schematical illustration of the plug connector 10' and jack connector 110' was for illustrational purposes only and it will be appreciated that the plug connector 10 and jack connector 110 may be connected together in a similar manner.

Figures 11, 12:
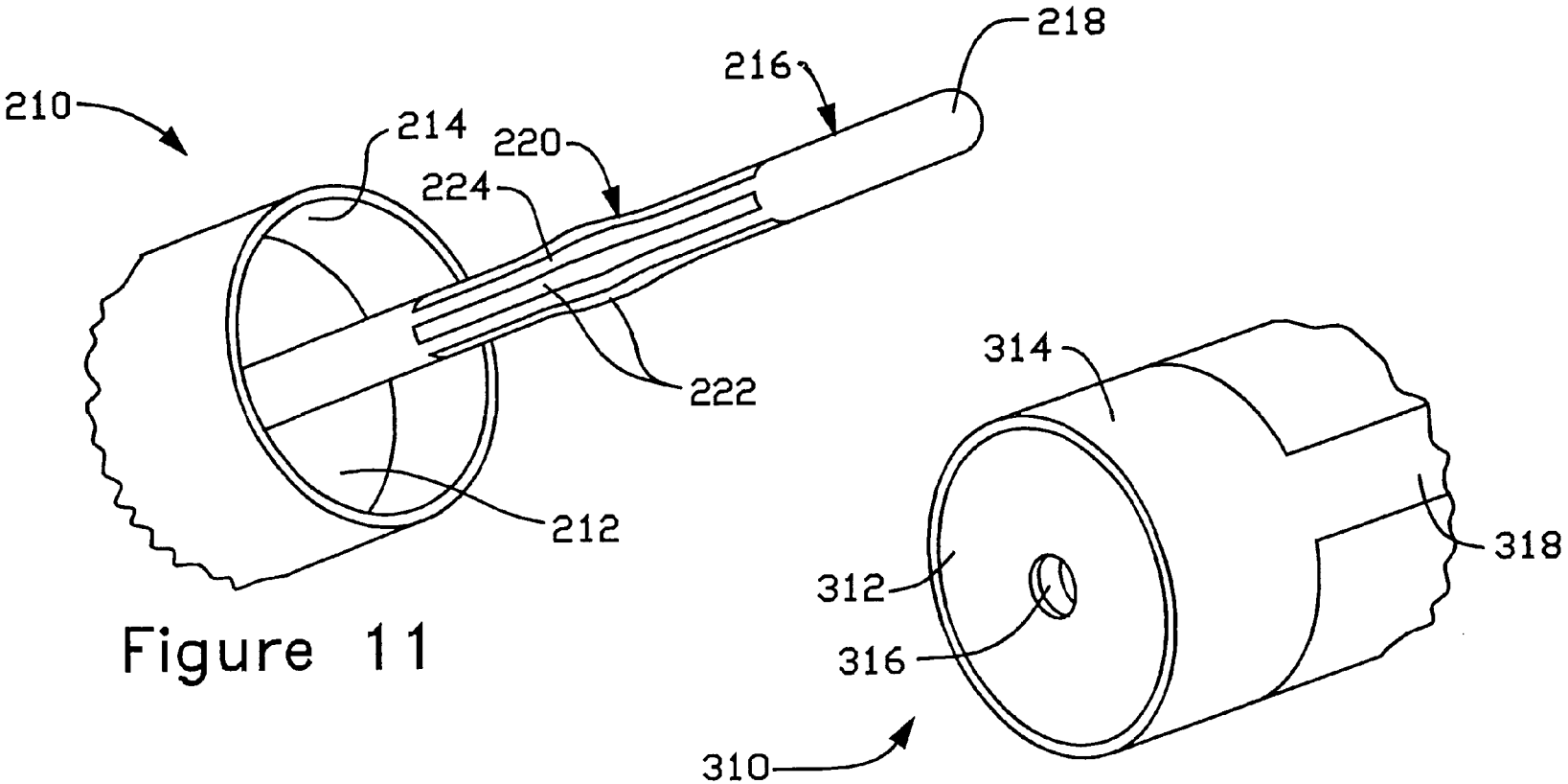
FIG. 11 is a partial schematical view of an RCA plug connector in accordance with a further embodiment of the present invention.
FIG. 12 is a partial schematical view of an RCA jack connector mateable with the RCA plug connector of FIG. 10.

Referring now to FIGS. 11 and 12, a further embodiment of a plug connector and jack connector in accordance with the present invention are illustrated generally at 210 and 310, respectively. The plug connector 210 is formed in accordance with an RCA configuration and includes a spring contact, described in more detail below. The plug connector 210 comprises an insulating ring 212 interposed between a sleeve 214 and a probe member 216. The insulating ring 212 is preferably comprised of a molded plastic material such as any of those discussed above. The sleeve 214 is composed of a conductive material and may be formed in a sheet and is disposed about the insulating ring 212. The sleeve 214 may be electrically connected typically to the shield of an electrical wire (not shown).

The probe member 216 comprises a rounded head 218 and a spring portion 220. The spring portion 220 comprises slots 222 disposed between bulged portions 224 of the probe member 216. In this manner, the probe member 216 is formed in one piece and is preferably composed of a metallic substance to provide conductive properties whereby a signal from a wire not shown may be conducted thereby.

The jack connector 310 comprises an insulating cylinder 312, a conductive band 314 and a central cavity 316. The insulating cylinder 312 may be formed of any suitably strong and durable material such as a plastic, for example, a polyolefin and is dimensioned to fit within the sleeve 214 of the plug connector 210. The conductive band 314 circumscribes the end of the insulating cylinder 312 and electrically contacts the sleeve 214 when the plug connector 210 is mated with the jack connector 310. A conductive line 318 connects the conductive band 314 with, e.g., a ground wire (not shown). The central cavity 316 is defined by a wall 320 which may be coated or provided with a conductive sleeve and is dimensioned to receive the probe member 216.

When the plug connector 210 is fitted together with the jack connector 310, the probe member 216 fits within the central cavity 316 whereby spring portion 220 will be compressed to provide increased friction and prevent undesirable disruption of electrical continuity.

Figure 13:
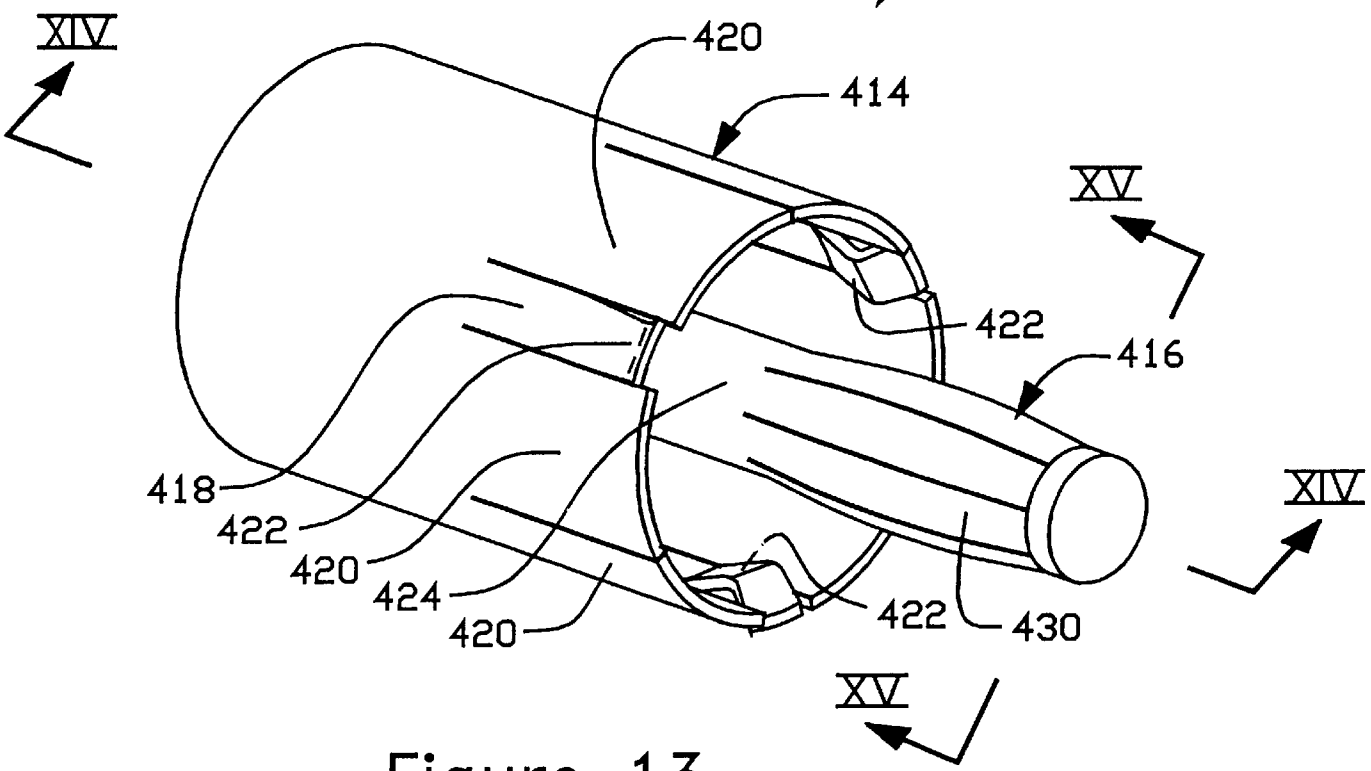
FIG. 13 is a perspective view of an RCA plug connector in accordance with a further embodiment of the present invention.
Figure 15:
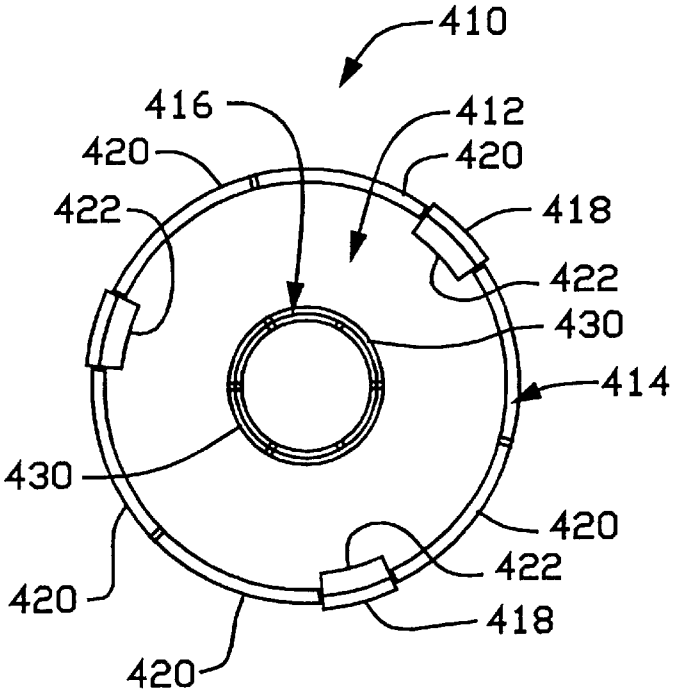
FIG. 15 is a sectional view taken along line XV of FIG. 13.
Figure 14:
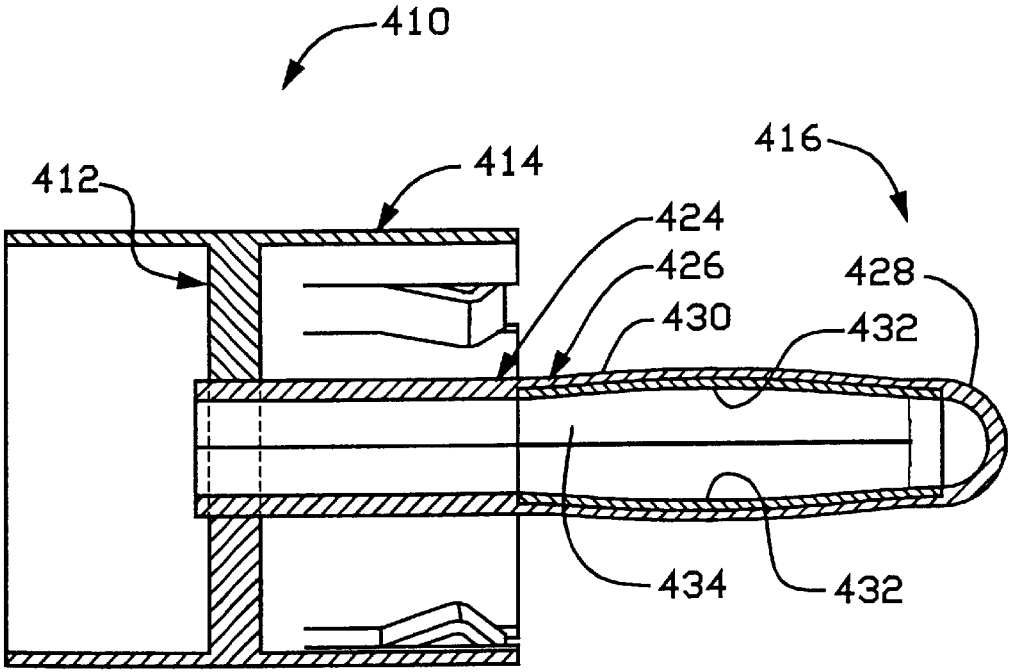
FIG. 14 is a sectional view taken along line XIV of FIG. 13.

A further embodiment of a plug connector in accordance with the present invention is illustrated generally at 410 in FIGS. 13, 14 and 15. It will be appreciated that the plug connector 410 includes an RCA configuration. The plug connector 410 comprises an insulating ring 412 interposed between a sleeve 414 and a probe member 416.

The insulating ring 412 may be composed of a plastic material such as any thermoplastic material discussed above and functions to separate the sleeve 414 and probe member 416 which are both conductive.

The sleeve 414 may be composed of, for example, copper, steel plated with, e.g., nickel, copper or even gold for a low resistance, brass, beryllium copper, phosphor bronze or other material or alloy. The sleeve comprises contact fingers 418 and 420 which engage a correspondingly shaped jack connector such as conductive band 314 (FIG. 12) of the jack connector 310. The contact fingers 418 each include a spring portion 422 comprising a generally V-shape in cross section. As best seen in FIG. 15, the spring portions 422 provide a reduced diameter and spring like action for increasing the contact pressure, e.g., on the conductive band 314.

The probe member 416 may be composed of a metallic substance such as any of those described above with respect to the sleeve 414 and comprises a tube portion 424, spring portion 426 and a nose portion 428. The spring portion 426 includes circumferentially spaced strips 430 which may be tempered and may engage both the tube portion 424 and nose portion 428. Members 432 and 434 may be provided within the probe member 416 and may support the strips 430.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A phone plug connector for mating with an associated jack connector having an insertion collar, the plug connector comprising:

a base;

a tubular member extending from the base along a central axis, the tubular member comprising:

a ground contact area;

a terminal end distal to the base and including a circumferential groove, the terminal end comprising a conductive material and being insulated from the ground contact area; and a conductive spring extending exteriorly along said tubular member and conductively connected to said ground contact area, said spring having an axial portion thereof that is bowed outward for interference engagement with said insertion collar of the associated jack connector.

2. The plug connector of claim 1 wherein the tubular member further comprises an intermediate conductive portion disposed between and insulated from the contact area and the terminal end.

3. The plug connector of claim 1 wherein the spring comprises at least one strip extending longitudinally along and being bowed radially outward of the central axis of the tubular member.

4. A plug connector for mating with a jack connector, the plug connector comprising:

a base;

a tubular member extending from the base, the tubular member including a contact area, a terminal end distal to the base, the terminal end including a conductive material that is insulated from the contact area and a circumferential groove; and a spring;

wherein said tubular member further includes an intermediate conductive portion disposed between and insulated from the contact area and the terminal end and said spring includes at least one strip extending longitudinally along said tubular member and being bowed radially outward of the central axis of the tubular member, and the at least one strip includes a plurality of circumferentially spaced strips at least one of which extends beyond that of the others into the base.

5. A plug connector for mating with a jack connector, the plug connector comprising:

a base;

a tubular member extending from the base, the tubular member including a contact area;

a terminal end distal to the base, the terminal end including a conductive material that is insulated from the contact area;

a circumferential grooves the circumferential groove being located on the terminal end; and a spring;

wherein said tubular member further includes an intermediate conductive portion disposed between and insulated from the contact area and the terminal end, said spring having at least one strip extending longitudinally along said tubular member and being bowed radially outward of the central axis of the tubular member, and wherein the at least one strip includes a plurality of circumferentially spaced metallic strips;

and the base includes a tubular shape defined by a plurality of circumferentially spaced members which are configured to fit between the metallic strips of the spring.

6. The plug connector of claim 1 wherein:

the contact area comprises a cylindrical portion having a side edge; and the spring comprises a plurality of circumferentially spaced strips extending from the side edge in a direction which is parallel to the central axis of the contact area.

7. The plug connector of claim 1 wherein the base is composed of an insulating material and further the plug connector comprises an insulating ring disposed between the terminal end and the spring.

8. The plug connector of claim 2 wherein the base is composed of an insulating material and further comprising a pair of insulating rings disposed about the intermediate conductive portion.

9. The plug connector of claim 1 further comprising a core disposed within the tubular member and the core comprising an insulating material disposed about at least one signal conductor.

10. The plug connector of claim 2 further comprising a core disposed within the tubular member and the core comprising an insulating material disposed about two signal conductors.

11. The plug connector of claim 2 wherein the base comprises a disc-shaped portion.

12. The plug connector of claim 2 further comprising a handle connected to the base.

13. The plug connector of claim 1 wherein the spring comprises a material selected from the group consisting of brass, copper, phosphor bronze, steel plated with gold and beryllium copper.

14. A phone plug connector for mating with a jack connector having a ground collar, the plug connector comprising:

a base;

a tubular member extending from the base along a central axis, the tubular member comprising:

a terminal end distal to the base, the terminal end comprising a conductive material insulated from the base and having a circumferential groove; and a spring portion adjacent the base and insulated from the terminal end, said spring portion comprising a plurality of annularly spaced, conductive spring elements defining an exterior portion of the tubular member to engage and electrically contact the ground collar on the jack connector.

15. An electrical phone plug connector which comprises:

a base;

an elongated tubular member extending from said base along a central axis, said tubular member including a conductive terminal end distal to said base, said terminal end of said tubular member including a circumferential groove that is generally coaxial with said tubular member;

at least one elongated electrically conductive spring disposed exteriorly along said tubular member in generally parallel relationship to the axis of said tubular member, said spring having an axial part thereof that has a generally hump shape intermediate the axial extremities thereof;

said tubular member further including a conductive, ground contact area along the outer face of said tubular member intermediate said base and said terminal end, and means insulating said terminal end from said ground contact area.

16. The plug connector of claim 15, wherein the tubular member further comprises an intermediate conductive portion disposed between and insulated from the ground contact area and the terminal end.

17. The plug connector of claim 15, wherein the axial part of said spring that has a generally hump shape intermediate the axial extremities thereof is bowed radially outward of the central axis of the tubular member.

18. The plug connector of claim 17, wherein the at least one elongated electrically conductive spring comprises a plurality of circumferentially spaced metallic strips.

19. The plug connector of claim 1, wherein the contact area comprises a cylindrical portion having a side edge; and the axial portion of the spring comprises a plurality of circumferentially spaced strips extending from the side edge in a direction which is parallel to the central axis of the contact area.

20. The plug connector of claim 15, wherein the base is composed of an insulating material and the plug connector further comprises an insulating ring disposed between the terminal end and the spring.

21. The plug connector of claim 16, wherein the base is composed of an insulating material and the plug connector comprises a pair of insulating rings disposed about the intermediate conductive portion.

22. The plug connector of claim 15, further comprising a core disposed within the tubular member and the core comprises an insulating material disposed about at least one signal conductor.

23. The plug connector of claim 15, further comprising a core disposed within the tubular member and the core comprises an insulating material disposed about two signal conductors.

24. The plug connector of claim 16, wherein the base comprises a disk-shaped portion.

25. The plug connector of claim 16, further comprising a handle connected to the base.

26. The plug connector of claim 15, wherein the spring comprises a material selected from the group consisting of brass, phosphor bronze, steel plated with gold and beryllium copper.

27. A plug connector in accordance with claim 14, wherein said spring portion is rigidly secured to said base.

28. A plug connector in accordance with claim 27, wherein said spring portion is manufactured from a single sheet of metal and said spring portion has axial extremities that are respectively first and second cylindrical sections, said spring elements including a plurality of outwardly bowed strips extending between said first and second cylindrical sections, each of said strips being disposed in generally parallel relationship to the axis of said tubular member.

29. A plug connector in accordance with claim 28, wherein said first cylindrical section is fixed rigidly to said base.

30. A plug connector in accordance with claim 1, wherein said spring is manufactured from a single sheet of metal and said spring has axial extremities that are respectively first and second cylindrical sections, said spring including a plurality of strips extending between said first and second cylindrical sections, each of said strips being disposed in generally parallel relationship to the axis of said tubular member.

31. A plug connector in accordance with claim 30, wherein said first cylindrical section is fixed rigidly to said base.

32. A plug connector in accordance with claim 31, wherein said tubular member further includes a core member, said core member having at least one conductor extending therein.

33. A plug connector in accordance with claim 15, wherein said at least one elongated electrically conductive spring is manufactured from a single sheet of metal and said spring has axial extremities that are respectively first and second cylindrical sections, said spring further including a plurality of strips extending between said first and second cylindrical sections, each of said strips being disposed in generally parallel relationship to the axis of said tubular member.

34. A plug connector in accordance with claim 33, wherein said first cylindrical section is fixed rigidly to said base.

* * * * *

UNITED STATES PATENT AND TRADEMARK OFFICE

CERTIFICATE OF CORRECTION

PATENT NO. : 6,533,617 B1
DATED : March 18, 2003
INVENTOR(S) : D'Addario

It is certified that error appears in the above-identified patent and that said Letters Patent is hereby corrected as shown below:

Column 3,
Line 5, delete "frictional".
Lines 14-15, before "tubular" insert -- generally --.
Lines 44-45, delete "strong material and is preferably spring tempered" and insert -- strong material. Preferably, the material of the strips 48 is spring tempered. --.

Column 4,
Line 3, before "tip" insert -- contact --.
Line 18, delete "stepped" and insert -- flanged --.
Lines 21-22, before "end" insert -- an --.
Line 62, delete "is" and insert -- may be --.

Column 5,
Line 3, change "plates 132" to read -- plates 132, 132' --.
Line 5, change "plate 132" insert -- plate 132, 132' --.
Line 10, change "132" insert -- 132' --.
Line 27, delete "is" and insert -- may be --.
Line 33, delete "stepped" and insert -- flanged --.
Line 45, change "152" to -- 152, 152' --.
Line 54, after "Also," delete "a".

Column 6,
Line 51, after "discussed above" insert -- and comprises a central aperture (not numbered) from which the probe member 216 extends --.

Column 7,
Line 38, delete "may engage both" and insert -- are disposed between --.

Column 8,
Line 34, after "circumferential" (first occurrence) delete "grooves" and insert -- groove, --.
Line 64, change "comprising" to -- comprising: --.

UNITED STATES PATENT AND TRADEMARK OFFICE

CERTIFICATE OF CORRECTION

PATENT NO. : 6,533,617 B1
DATED : March 18, 2003
INVENTOR(S) : D'Addario

It is certified that error appears in the above-identified patent and that said Letters Patent is hereby corrected as shown below:

Column 9,
Line 1, change "comprising" to -- comprising: --.

Signed and Sealed this

First Day of June, 2004

JON W. DUDAS
*Acting Director of the United States Patent and Trademark Office*